United States Patent [19]

Kaneda

[11] 4,145,638

[45] Mar. 20, 1979

[54] DISCHARGE LAMP LIGHTING SYSTEM USING SERIES CONNECTED STARTERS

[75] Inventor: Isao Kaneda, Otsu, Japan

[73] Assignee: NEC Sylvania Corporation, Tokyo, Japan

[21] Appl. No.: 851,943

[22] Filed: Nov. 16, 1977

Related U.S. Application Data

[63] Continuation-in-part of Ser. No. 579,092, May 20, 1975, Pat. No. 4,081,718.

[51] Int. Cl.[2] ..... H05B 41/16

[52] U.S. Cl. ..... 315/323; 315/97; 315/101; 315/103; 315/189; 315/244; 315/324

[58] Field of Search ..... 315/95, 97, 99, 101, 315/103, 105, 187, 189, 244, 323, 324, DIG. 5

[56] References Cited

U.S. PATENT DOCUMENTS

| | | | |
|---|---|---|---|
| 3,324,349 | 6/1967 | Moerkens et al. | 315/323 X |
| 3,582,709 | 6/1971 | Furui et al. | 315/99 X |
| 3,665,243 | 5/1972 | Kaneda et al. | 315/244 X |

*Primary Examiner*—Eugene R. LaRoche
*Attorney, Agent, or Firm*—W. G. Fasse; D. F. Gould

[57] ABSTRACT

The present discharge lamp system comprises two or more serially connected discharge lamps connected across a pair of power input supply terminals through a ballast circuit and two or more serially connected semiconductor starter circuits. The starters are connected in parallel with their respective discharge lamps and have inherent breakdown voltages, whereby the total value of the breakdown voltages for each starter is higher than the source voltage at the power supply terminals. The system further comprises voltage dividing circuit elements enabling the conduction of one of the starters before the conduction of the other starter or starters in response to the source voltage, whereby the starters operate sequentially. At least one of the starters employs a backswing booster including a series circuit of a nonlinear inductor and a switching semiconductor and a capacitor connected in parallel with the series circuit to provide a sufficient starting voltage for the associated discharge lamp.

14 Claims, 3 Drawing Figures

DISCHARGE LAMP LIGHTING SYSTEM USING SERIES CONNECTED STARTERS

BACKGROUND OF THE INVENTION

This application is a continuation-in-part application of Ser. No. 579,092; Filed: May 20, 1975, now U.S. Pat. No. 4,081,718.

This invention relates to a discharge lamp lighting system for two or more discharge lamps using two or more starter circuits. More particularly, the invention relates to discharge lamp lighting systems using starter circuits of the backswing booster type.

In recent years various types of discharge lamp operating devices employing solid state circuits have been developed. One type of such device uses a voltage booster connected to produce a backswing voltage for starting a discharge lamp, as disclosed in U.S. Pat. Nos. 3,665,243; 3,758,818; 3,753,037; 3,866,088; and 3,942,069. Such known starters basically comprise a first oscillation circuit having a power source, a substantially linear inductor and a capacitor connected in series; a second oscillation circuit is connected in parallel with the capacitor and has a series connected, saturable, nonlinear inductor and a thyristor type voltage-responsive switching element; and a third oscillation circuit comprises the saturable nonlinear inductor and its equivalent distributed capacity. The discharge lamp is connected in parallel with the capacitor, so that the lamp is ignited by the oscillation voltage generated across the capacitor. In such a case, the thyristor type switching element has a breakdown voltage lower than the instantaneous voltage from the power source side so as to drive the switching element by the source side voltage. When two or more switching elements are connected in series for starting two or more discharge lamps, the power source circuit must provide an instantaneous voltage that is higher than the total of the breakdown voltages of the series connected switching semiconductors. The above U.S. Patents do disclose a power source circuit wherein the source voltage may be less than the total breakdown voltage of the series semiconductors employed in the boosters in series connection.

OBJECTS OF THE INVENTION

In view of the foregoing, it is the aim of the invention to achieve the following objects singly or in combination:

- to provide an improved electronic starter type lighting device for discharge lamps;
- to provide a miniature, small size ballast for discharge lamps, in which two or more starters connected in series with one another are employed;
- to provide a lighting device in which the ignition operation of two or more serially connected starters is assured due to the use of a voltage dividing means, such as impedance means connected across the starter, even though the source voltage is lower than the total breakdown voltage of each starter;
- to provide a discharge lamp lighting device in which the required operating voltage is reduced for economical advantages as compared to conventional devices;
- to provide a device for the sequential igniting of two discharge lamps employing separate starters, in which malfunctioning of the starters during lamp operation is prevented with certainty due to the use of higher starter breakdown voltages; and
- to use breakdown voltages which are higher than the increased lamp operating voltage at low ambient temperatures.

SUMMARY OF THE INVENTION

These and other objects, advantages and features are attained, in accordance with the invention, by providing a lighting system for a plurality of discharge lamps which comprises, in combination, two or more starters connected in series each of which is connected in parallel with a separate discharge lamp. The operating voltage for the lighting system is supplied from the power supply terminals, and the sum or total value of breakdown voltages of the series connected starters is preferably higher than the source voltage.

BRIEF FIGURE DESCRIPTION

In order that the invention may be clearly understood, it will now be described by way of example with reference to the accompanying drawings, wherein.

DETAILED DESCRIPTION OF PREFERRED EXAMPLE EMBODIMENTS

Figure 1:
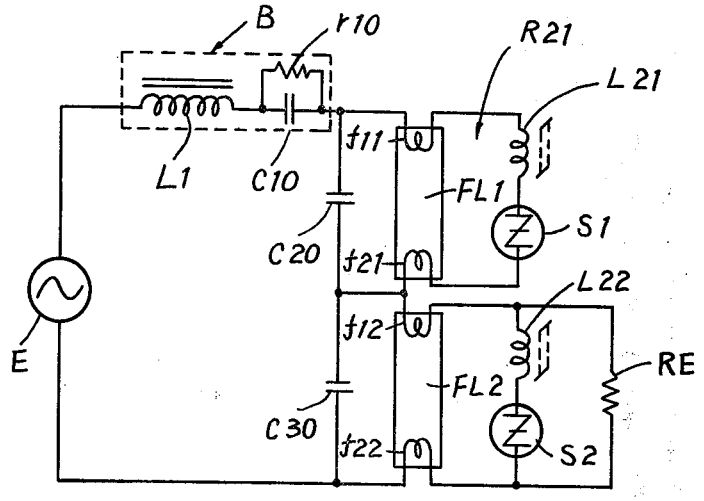
FIG. 1 is a circuit diagram illustrating an embodiment of a sequential lighting system for discharge lamps, in which the total lamp voltage of series connected lamps is close to the power source voltage.

FIG. 1 illustrates a circuit arrangement of a discharge lamp lighting system for a pluratity of discharge lamps, for example, two discharge lamps FL1 and FL2 connected in series. The lighting system comprises a power source circuit including an a.c. power source E and a lead-phase choke ballast B connected in series. First and second starter circuits comprise the high voltage generating circuits R21 and R22 and impedance means including a high resistance resistor RE connected to the second discharge lamp FL2. The ballast B comprises a series circuit of a choke coil L1 having a substantially linear inductance characteristic and a phase advancing capacitor C10 connected in parallel to a discharging resistor r10.

The high voltage generating circuits R21 and R22 comprise capacitors C20 and C30 respectively for oscillation and also noise prevention, nonlinear inductors L21 and L22 and respective switching semiconductors S1 and S2 of the bidirectional diode thyristor type, hereinafter called the "thyristors."

In this circuit, the resistor RE serves as voltage divider circuit or a charging path for a capacitor 20 of the circuit R21. Thus, during the first half cycle of the voltage of the power source E, the capacitor C20 is charged by way of the resistor RE, so that a higher voltage appears across the circuit R21 and across the circuit R22. The applied voltage across the capacitor C20 theoretically approaches the maximum instantaneous voltage of source E, but such voltage renders the thyristor S1 conductive when the voltage applied thereto exceeds the breakdown voltage of the thyristor S1 of the starter circuit R21.

The conduction of the thyristor S1 drives the starter circuit R21 to generate a high voltage oscillation in a known manner. Since the impedance of the circuit R21 is now very low, the source voltage from the power source E is applied mainly across the resistor RE or the thyristor S2. Thus, the circuit R22 is driven due to the application thereto of a higher voltage than the breakdown voltage of the thyristor S2 of the circuit R22.

Since the filaments f11, f21, f12 and f22 are in series with the starters, operation of the starters permits heating current to flow through these filaments of the lamps FL1 and FL2 respectively. Consequently, the lamps FL1 and FL2 are sequentially ignited. It is noted that the source voltage may thus be selected to have a peak value between the sum of the operating lamp voltages of lamps FL1 and FL2 and the breakdown voltages of either of the thyristors S1 and S2. In other words, the reliable sequential ignition of the starters is obtained, even though the source voltage is less than the sum of the breakdown voltages of both starter circuits R21 and R22.

The use of a lower source voltage is advantageous since it enables the manufacturing of a smaller size device including a smaller ballast. It also prevents malfunctioning of the starter during lamp operation, since the operation lamp voltage is increased even at low ambient temperatures and does not approach the higher breakdown voltage of the starter that can be advantageously employed in the circuit of the invention.

Figure 2:
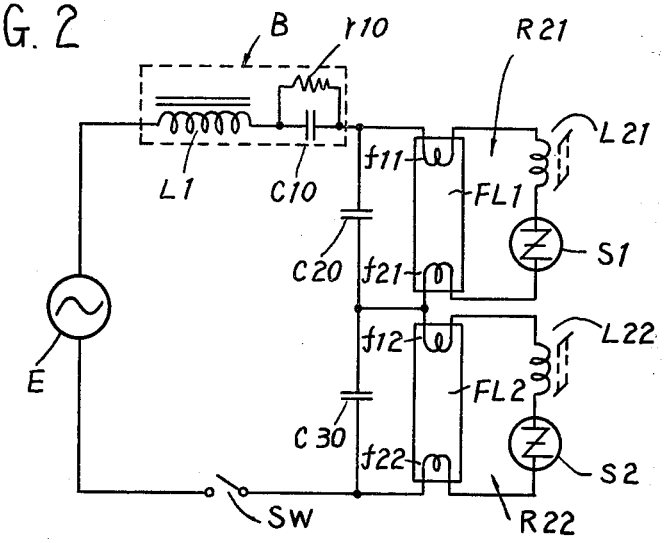
FIG. 2 shows a modification of the circuit of FIG. 1, wherein the capacitances of the two starter circuits are different from one another.

FIG. 2 is a modification of FIG. 1, wherein the function of the voltage dividing means comprising the parallel resistor RE and the capacitor C20 in FIG. 1, is accomplished by the use of different capacitances for the capacitors C20 and C30 in the starter circuits R21 and R22. In this case the resistor RE may be omitted. The reference numbers used in FIG. 2 are the same as those of FIG. 1.

In FIG. 2, the capacitance of the capacitor C30 differs from the capacitance of the capacitor C20. For instance, C20 may be smaller than C30. When the switch SW is closed in this circuit arrangement, partial voltages which may be divided due to the inverse proportion of the capacitances of each capacitor, are applied to the starter circuits R21 and R22. Due to the relation $C20 < C30$, for instance, of $C20 = 0.006\ \mu F$ and $C30 = 0.022\ \mu F$, the greater part of the source voltage appears initially across the starter circuit R21 or the thyristor S1. Thus, when the voltage reaches to its breakdown voltage, the starter circuit R21 is first operated to generate a high voltage oscillation for starting the discharge lamp FL1. As explained with reference to FIG. 1, the operation of the starter circuit R22 then occurs sequentially.

Figure 3:
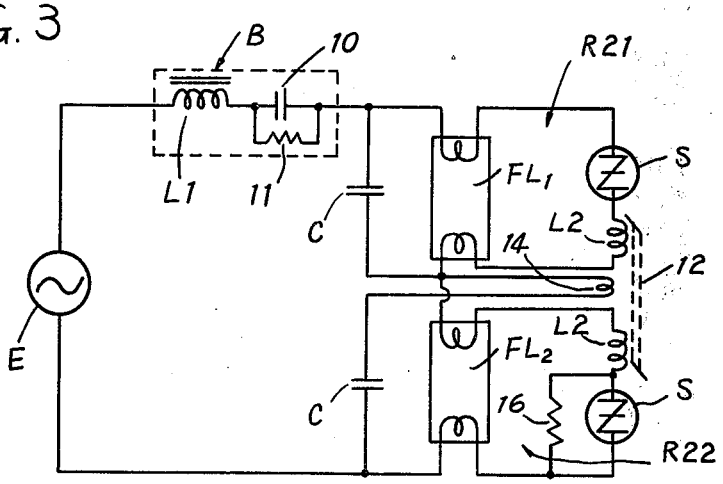
FIG. 3 is another modification of the circuit of FIG. 1, employing a common core for the nonlinear inductors and also using bias means.

FIG. 3 shows a circuit arrangement of another modification of FIG. 1, wherein a bias coil 14 is added to the starter circuit R22, and a common core 12 including leakage paths is also used for the two nonlinear inductors L2. The resistor RE of FIG. 1 is replaced by an equivalent circuit of a resistor 16 and the nonlinear inductor L2 in series.

In FIG. 3, the lighting device comprises first and second discharge lamps FL1 and FL2 connected in series and first and second starter circuits R21 and R22. For example, the first discharge lamp FL1 may be a 40 watt circular fluorescent lamp FL1 and the second discharge lamp may be a 20 watt circular fluorescent lamp. Both lamps are connected by way of ballast means B to the power supply terminals of the commercial line E having a source voltage of 200 volts r.m.s. The ballast means B may comprise a series connection of a choke coil L1 and a phase advancing capacitor 10, with a discharging resistor 11 connected in parallel to the capacitor 10. Each of the starter circuits comprises a series circuit of a nonlinear inductor L2 and a switching element of the thyristor S, and a parallel capacitor C for oscillation. The nonlinear inductors L2 have an equivalent distributed capacitance (not shown) and are wound on a common magnetic core 12. The bias coil 14 is coupled magnetically to the nonlinear inductor L2.

When the bias coil 14 is coupled electrically to the charging path of the capacitor C in the second starter circuit R22, the magnetic flux density of the core varies in response to the exciting current through the bias coil 14, so as to control the output of the oscillation voltage. The breakdown voltage for the thyristors in circuits R21 and R22 may be different from one another.

In order to improve the operation of this circuit, voltage dividing means comprising a resistor 16 is connected across the second discharge lamp FL2 through the nonlinear inductor L2 across the thyristor S in the second starter circuit R22 to provide a desired impedance of L2 and 16 for the second starter circuit R22 when the thyristor S of the second starting circuit is not conducting. Thus, the starter circuit R21 may be first driven to its oscillatory state before the starter circuit R22 starts oscillating. In other words, the resistor 16 acts as a divider circuit for the source voltage and serves as a charging path for the capacitor C across the first starter R21, thereby causing the breakdown of the thyristor S in the first circuit R21, before the breakdown of the thyristor S in the second circuit R22. Thus, the resistor 16 acts in a manner similar to the resistance RE in FIG. 1, and also has the advantage of causing smaller power loss in contrast to the resistor RE.

In this arrangement the total lamp voltage of the discharge lamps FL1 and FL2 connected in series is about 160 volts (100 + 60 volts), whereas the source voltage of the power source is 200 volts. The terminal voltage of the ballast B will be lowered by an improved power factor, due to the use of the phase advancing capacitor 10, although this capacitor 10 may be omitted. To prevent malfunctioning of the thyristors S, it is necessary for the breakdown voltage of the thyristor S in the first circuit R21 to be higher than the lamp operating voltage of the first discharge lamp FL1 exclusive of any spike voltage across the first discharge lamp FL1, and that the breakdown voltage of the thyristor S in the second circuit R22 is also higher than the lamp operating voltage of the second discharge lamp FL2 exclusive of any spike voltage across the second discharge lamp FL2, even when the lamp voltage is increased at lower ambient temperatures. In this regard, though it is noted that the nonlinear inductor has a spike voltage checking function. The present invention also teaches that the breakdown voltages of the thyristors S can be selected above maximum instantaneous voltage of the lamp operating voltages respectively, so that smaller nonlinear inductors may be used to prevent spike voltage at low operating temperatures.

Further, the same effect can be obtained in a circuit in which the ballast means B in the above embodiments is replaced by a choke ballast having only a lag phase, by removing the capacitor 10 and its resistor 11.

The above disclosure refers to series and parallel connections of elements and circuits even where the filaments of the discharge lamps are operatively connected in the related circuits. Hence, the terms "series" and "parallel" as used herein include such interconnections.

Although the invention has been described with reference to specific example embodiments, it is to be understood that it is intended to cover all modifications and equivalents within the scope of the appended claims.

What is claimed is:

1. A discharge lamp lighting system for first and second discharge lamp means including respective filament means, said system comprising power input supply terminals, means for connecting said first and second discharge lamp means in series to form a first series circuit, ballast means connected in series with said first series circuit, said ballast means and said first series circuit being connected serially between said power supply terminals, said ballast means comprising a substantially linear inductor, a second series circuit comprising first and second starting booster means, means connecting said first and second starting booster means in parallel with said first and second discharge lamp means respectively, said first starting booster means comprising a capacitor connected in parallel with said first discharge lamp means at the power supply side thereof, a third series circuit comprising a first nonlinear inductor connected in series with a first switching semiconductor having a given breakdown voltage, and means connecting said third series circuit in parallel with said first discharge lamp means opposite the power supply side thereof, said second starting booster means comprising a second capacitor connected in parallel with said second discharge lamp means at the power supply side thereof, a fourth series circuit comprising a second nonlinear inductor connected in series with a second switching semiconductor also having a given breakdown voltage, and means connecting said fourth series circuit in parallel with said second discharge lamp means opposite the power supply side thereof, and wherein the sum of the breakdown voltages of said first and second switching semiconductors is higher than the source voltage at said power supply terminals, said system further comprising voltage dividing means responsive to voltages at said power supply terminals for applying a breakdown voltage to the switching semiconductor of said first starting booster means before the operation of said second starting booster means, whereby said first and second starting booster means are sequentially operated for starting said discharge lamp means in a stable manner.

2. The discharge lamp lighting system of claim 1, wherein said voltage dividing means comprises a resistor connected in parallel with said second starting booster means.

3. The discharge lamp lighting system of claim 1, further comprising a bias coil connected in series with the capacitor which is connected in parallel with said second starting booster means, said bias coil being magnetically coupled to said second nonlinear inductor.

4. The discharge lamp lighting system of claim 1, wherein said voltage dividing means comprise said first mentioned capacitor and said second capacitor, the capacitance of said first and second capacitors being different from one another, whereby said first and second starters are sequentially operated.

5. The discharge lamp lighting system of claim 1, wherein said ballast means further comprise a phase advancing capacitor connected in series with said linear inductor.

6. The discharge lamp lighting system of claim 1, wherein said voltage dividing means comprise a resistor connected in parallel with the switching semiconductor of said second starter.

7. The discharge lamp lighting system of claim 1, wherein said voltage dividing means comprise a series circuit of a resistor and said nonlinear inductor of said second starter, said resistor being connected in parallel with the switching semiconductor of said second starter.

8. A discharge lamp lighting system comprising power input supply terminals, a first series circuit of first and second discharge lamp means, ballast means connected in series with said first series circuit, said ballast and said first series circuit being connected serially between said power supply terminals, said ballast means comprising a substantially linear inductor, and first and second backswing boosters connected in parallel with said first and second discharge lamps respectively, each backswing booster comprising a second series circuit of a switching semiconductor and a nonlinear inductor, said nonlinear inductors having distributed capacitances and a common core, said system further comprising igniting means enabling the switching semiconductor of said first backswing booster to breakdown before the breakdown of said switching semiconductor of said second backswing booster in response to voltages at said power supply terminals and a first capacitor connected in parallel with said first backswing booster, as well as a series circuit of a coil and a second capacitor connected in parallel with said second backswing booster, said coil being magnetically coupled to said core.

9. The discharge lamp lighting system of claim 8, wherein said igniting means comprise a resistor connected in parallel with the switching semiconductor of said second backswing booster.

10. The discharge lamp lighting system of claim 9, further comprising a capacitor connected in parallel with said first backswing booster.

11. The discharge lamp lighting system of claim 9, comprising a capacitor connected in parallel with said second backswing booster.

12. The discharge lamp lighting system of claim 8, wherein a first capacitor is connected in parallel with said first backswing booster, said igniting means comprising a second capacitor connected in parallel with said second backswing booster and having a capacitance that differs from the capacitance of said first capacitor.

13. The discharge lamp lighting system of claim 8, comprising capacitor means connected in parallel with said first and second backswing boosters, and wherein said ballast means further comprises a parallel connected resistor and capacitor connected in series with said linear inductor.

14. The discharge lamp lighting system of claim 13, wherein said igniting means comprise a resistor connected in parallel with the switching semiconductor of said second backswing booster.

* * * * *